US007331207B2

(12) United States Patent
Borgwarth

(10) Patent No.: US 7,331,207 B2
(45) Date of Patent: Feb. 19, 2008

(54) METAL SHAPING APPARATUS

(75) Inventor: Dennis Borgwarth, Andover, MN (US)

(73) Assignee: Hot Metal Customs, Inc., Andover, MN (US)

( * ) Notice: Subject to any disclaimer, the term of this patent is extended or adjusted under 35 U.S.C. 154(b) by 160 days.

(21) Appl. No.: 11/373,543

(22) Filed: Mar. 10, 2006

(65) Prior Publication Data

US 2006/0201231 A1 Sep. 14, 2006

Related U.S. Application Data

(60) Provisional application No. 60/660,782, filed on Mar. 11, 2005.

(51) Int. Cl.
*B21J 13/00* (2006.01)

(52) U.S. Cl. ..... 72/448; 72/375; 72/441; 72/446; 72/481.1; 72/453.07; 72/435; 72/472

(58) Field of Classification Search ..... 72/375, 72/441, 446, 448, 473, 453.07, 435, 440, 72/481.1, 472

See application file for complete search history.

(56) References Cited

U.S. PATENT DOCUMENTS

| | | | | | |
|---|---|---|---|---|---|
| 52,894 | A | * | 2/1866 | Shaw | 72/435 |
| 1,355,291 | A | * | 10/1920 | Urbaner | 72/434 |
| 1,386,891 | A | * | 8/1921 | Mayer | 72/464 |
| 1,394,722 | A | * | 10/1921 | Fogde | 72/322 |
| 1,428,612 | A | * | 9/1922 | Sheehy | 72/431 |
| 1,454,633 | A | * | 5/1923 | Fisher | 72/445 |
| 1,485,486 | A | * | 3/1924 | Depew | 72/481.6 |
| 1,551,347 | A | * | 8/1925 | Trombetta | 318/161 |
| 1,791,332 | A | * | 2/1931 | Strakey et al. | 72/434 |
| 2,163,715 | A | * | 6/1939 | Stull | 72/375 |
| 2,165,504 | A | * | 7/1939 | Pfauser | 72/392 |
| 2,187,110 | A | * | 1/1940 | Champayne | 72/441 |
| 4,181,002 | A | | 1/1980 | Eckhold et al. | |
| 4,372,183 | A | | 2/1983 | Lehtinen | |
| 6,427,515 | B1 | | 8/2002 | Kuhne | |

OTHER PUBLICATIONS

SHOPDOG, Pro16 Reciprocating Metalshaping Machine and Freehead Power Hammer; www.shopdog.net; 1 page; date unknown; location unknown.

Pullmax Inc.; Pullmax P201 Universal Machines; www.pullmaxinc.com; 2 pages, Feb. 2005, Rolling Meadows, IL.

Eckold AG; Uniformtechnik; www.ekold.com; 3 pages; Jan. 2006; Switzerland.

* cited by examiner

*Primary Examiner*—Dmitry Suhol
(74) *Attorney, Agent, or Firm*—Patterson, Thuente, Skaar & Christensen, P.A.

(57) ABSTRACT

A power hammer assembly providing forming capabilities while remaining economical with respect to performance, vibration, footprint size and acquisition costs. The power hammer assembly can provide for a single stroke speed and/or a single set stroke with respect to the striking of die assemblies against a piece of metal. The power hammer assembly can provide for a large throat area and/or a larger die gap for ease of use. The power hammer assembly can include adjustment features allowing for the use of die sets of varying configurations such as, for example, shank size, shank length or alternatively, die sets fabricated for use with other machinery. In addition, the power hammer assembly can include a belt transmission assembly designed to slip in the event of die interference during set-up or operation so as to avoid damaging the power hammer assembly.

13 Claims, 9 Drawing Sheets

METAL SHAPING APPARATUS

PRIORITY CLAIM

The present application claims priority to U.S. Provisional Application No. 60/660,782, filed Mar. 11, 2005, and entitled, "METAL SHAPING APPARATUS," which is herein incorporated by reference in its entirety.

FIELD OF THE INVENTION

The invention relates generally to the field of shaping metal. More particularly, the present invention pertains to a power hammer assembly capable of economically providing three-dimensional shaping capabilities.

BACKGROUND OF THE INVENTION

A variety of methods and machines are presently available for shaping metal into three-dimensional parts. Recently, the popularity of such metal shaping methods and machines has been increased due to the number of television programs dealing with custom metal shaping in the context of motorcycle and automobile customization. As such, a new generation of potential customizers and users has been introduced to the art and skill of metalworking.

Prior to the development of power machinery, metal forming and customization was accomplished through hand forming. Eventually, the development of controlled, powered machinery such as, for example, power hammers and forming machines available from companies such as Pullmax of Sweden and Eckold of St. Andreasberg, Germany, as well as those disclosed in U.S. Pat. No. 4,181,002 to Eckhold et al., U.S. Pat. No. 4,372,183 to Lehtinen and U.S. Pat. No. 6,427,515 to Kuhne, each of which is herein incorporated by reference in their entirety, provided metal workers with increased forming capabilities while decreasing production times.

Unfortunately, using presently available power hammers and formers can subject users to a number of inherent disadvantages. Generally, presently available power hammers and formers are expensive and may cost on the order of tens of thousands of dollars putting them out of reach of all but the largest metalworking operators. Presently, available power hammers and formers tend to be bulky and occupy large footprints making them unsuitable for small-scale operations. In addition, presently available power hammers and formers can require precise, custom machined die sets, which may be unusable with other machinery, in order to provide proper operational clearance. Finally, presently available power hammers and formers can be operated by linkage drives that have the capacity to literally destroy the machines if proper die set-ups and clearances are not maintained.

SUMMARY OF THE INVENTION

The present disclosure addresses a power hammer assembly providing users with the metal forming advantages associated with power machinery at a reduced expense and in a smaller footprint than presently available power hammer systems. In general, the power hammer assembly of the present invention provides three-dimensional shaping capabilities, which have application in the forming of custom metal products such as, for example, customized motorcycle and automotive parts. The power hammer assembly of the present disclosure can be fabricated and assembled in a kit fashion with commonly available tools to reduce costs. Alternatively, the power hammer assembly of the present disclosure can be purchased in an assembled configuration.

In one aspect, a power hammer assembly of the present disclosure provides powered forming capabilities while remaining economical with respect to performance, vibration, footprint size and acquisition costs. In some embodiments, the power hammer assembly can comprise a power assembly for providing a single stroke speed and/or a single set stroke with respect to the striking of die assemblies against a piece of metal. In some embodiments, the power hammer assembly of the present invention can comprise a larger throat area and/or a larger die gap than presently available power hammers to facilitate ease of use. In some embodiments, the power hammer assembly of the present invention can comprise adjustment features allowing for the use of die sets of varying configurations such as, for example, shank size, shank length or alternatively, die sets fabricated for use with other machinery. In some embodiments, the power hammer assembly of the present invention can comprise a belt transmission assembly designed to slip in the event of die interference during set-up or operation so as to avoid damaging the power hammer assembly. In some embodiments the power hammer assembly of the present invention includes fine adjustment means for spacing between the upper and lower die.

In another aspect, a method of forming metal pieces with a power hammer assembly is disclosed and described.

In yet another aspect, the present disclosure relates to a kit for fabrication and assembly of a power hammer assembly using commonly available tools and tooling.

The above summary of the various representative embodiments of the disclosure is not intended to describe each illustrated embodiment or every implementation of the invention. The figures in the detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
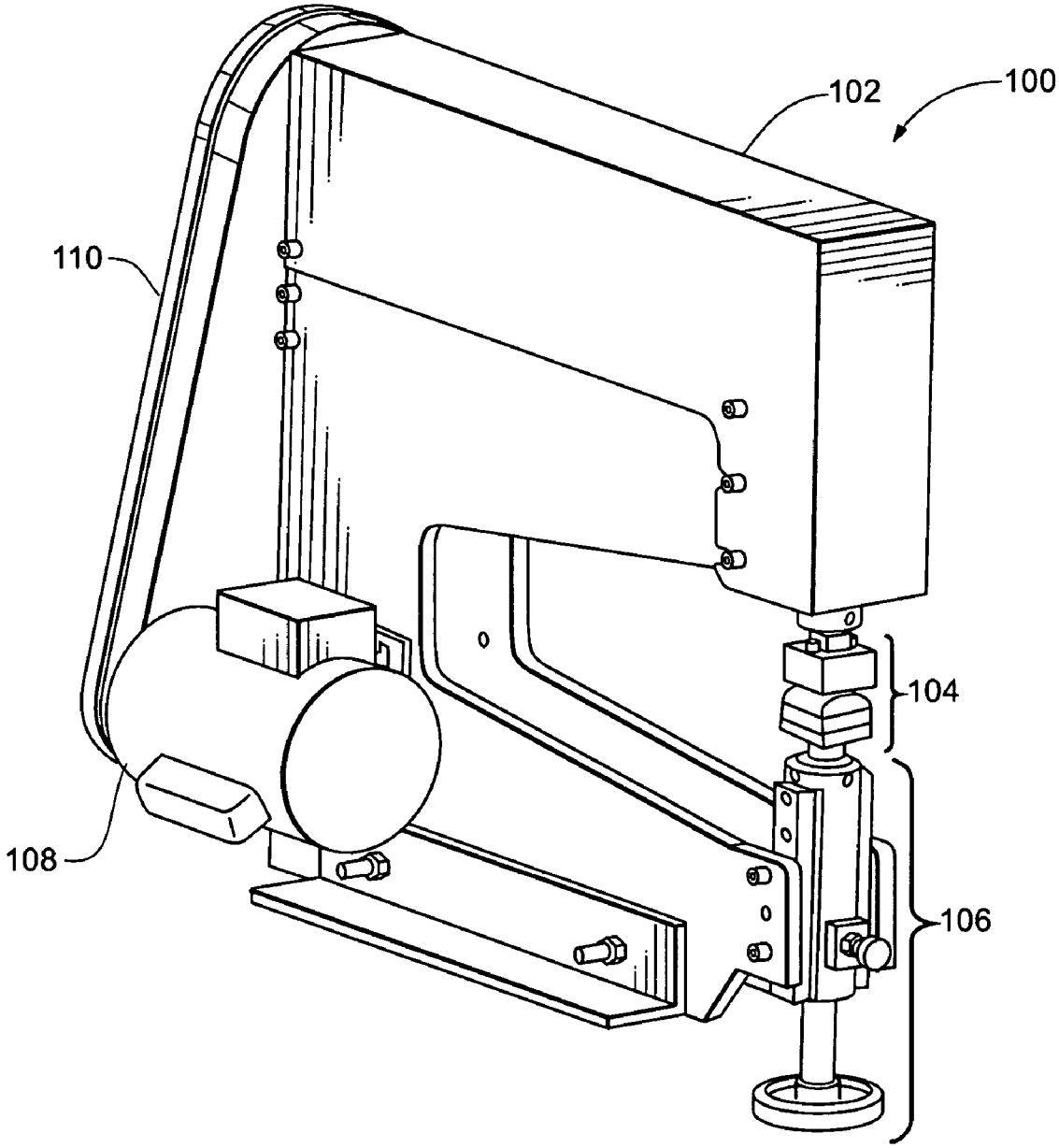
FIG. 1 is a perspective view of an embodiment of a power hammer assembly.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE PREFERRED EMBODIMENTS

As illustrated in FIGS. 1, 2, 3, 4, 5, 6, 7, 10 and 10*a*, a power hammer assembly 100 of the present invention provides the ability to shape metal with a reduced footprint, vibration-free power tool. With reference to FIG. 1, power hammer assembly 100 generally comprises a body assembly 102, a forming die portion 104, a die adjustment portion 106, a motor portion 108 and a belt transmission portion 110. Power hammer assembly 100 can be fabricated so as allow assembly with the use of suitable fasteners 111 such as, for example, screws.

Figure 2:
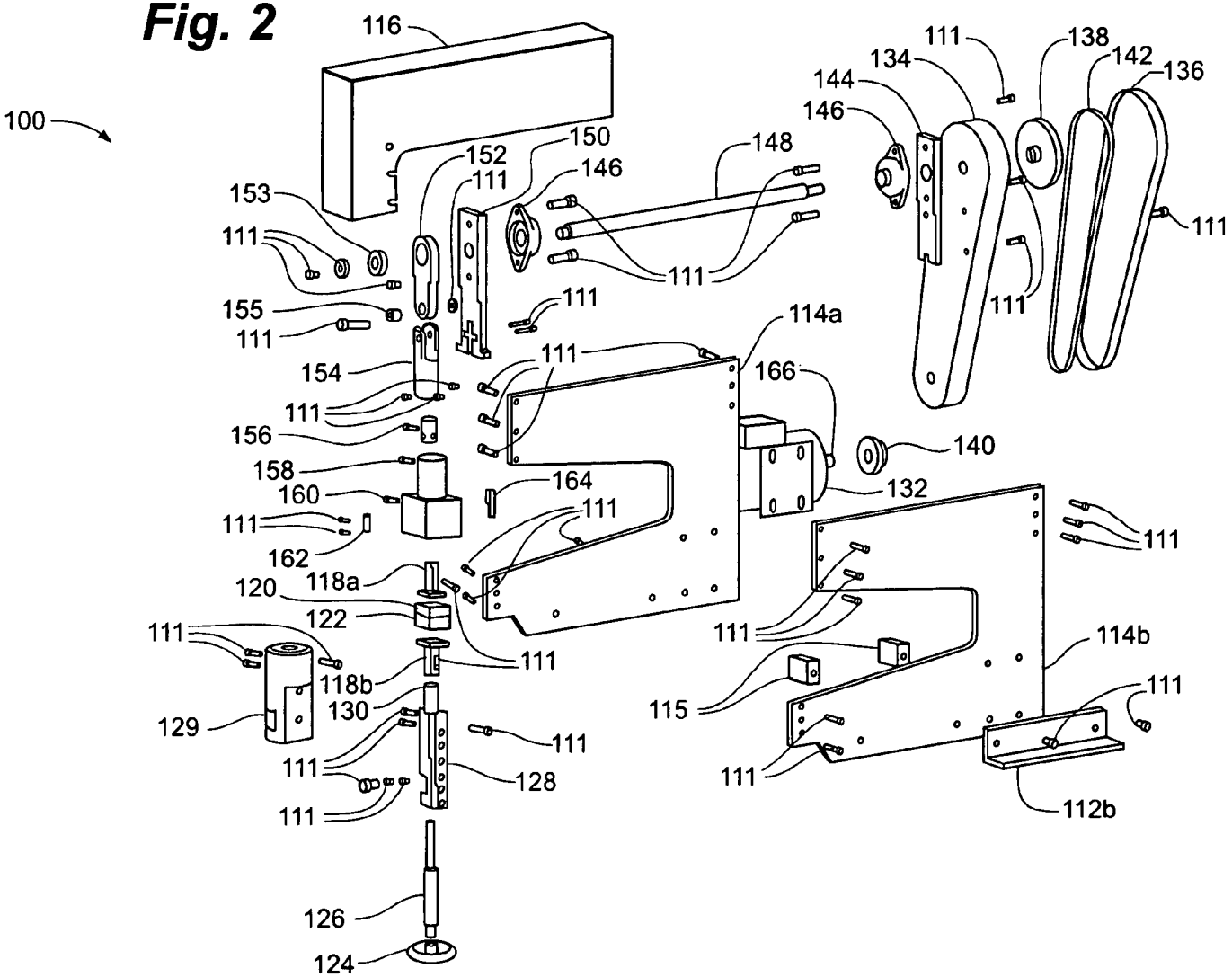
FIG. 2 is an exploded, perspective view of the power hammer assembly of FIG. 1.
Figure 3:
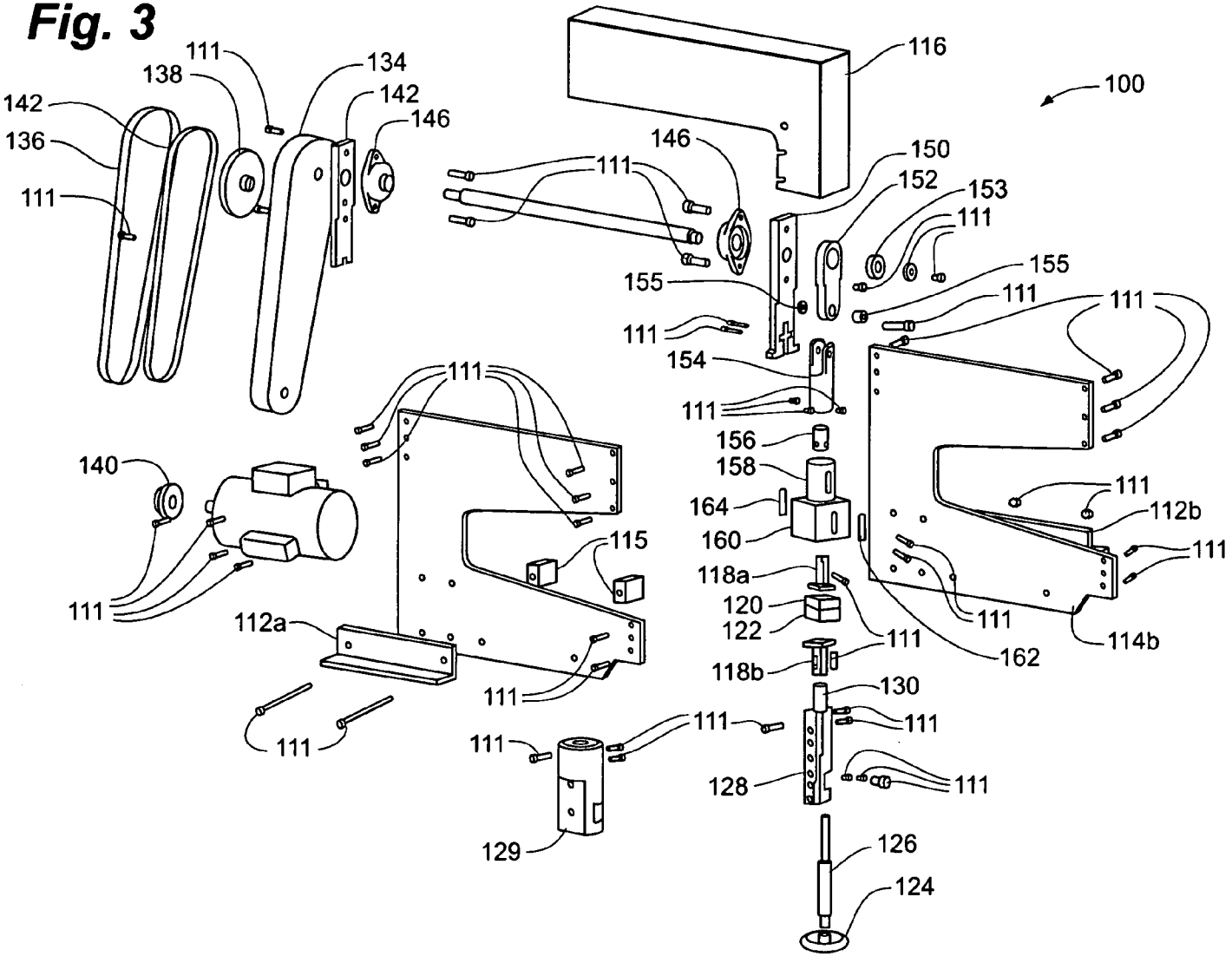
FIG. 3 is an exploded, perspective view of the power hammer assembly of FIG. 1.
Figure 8:
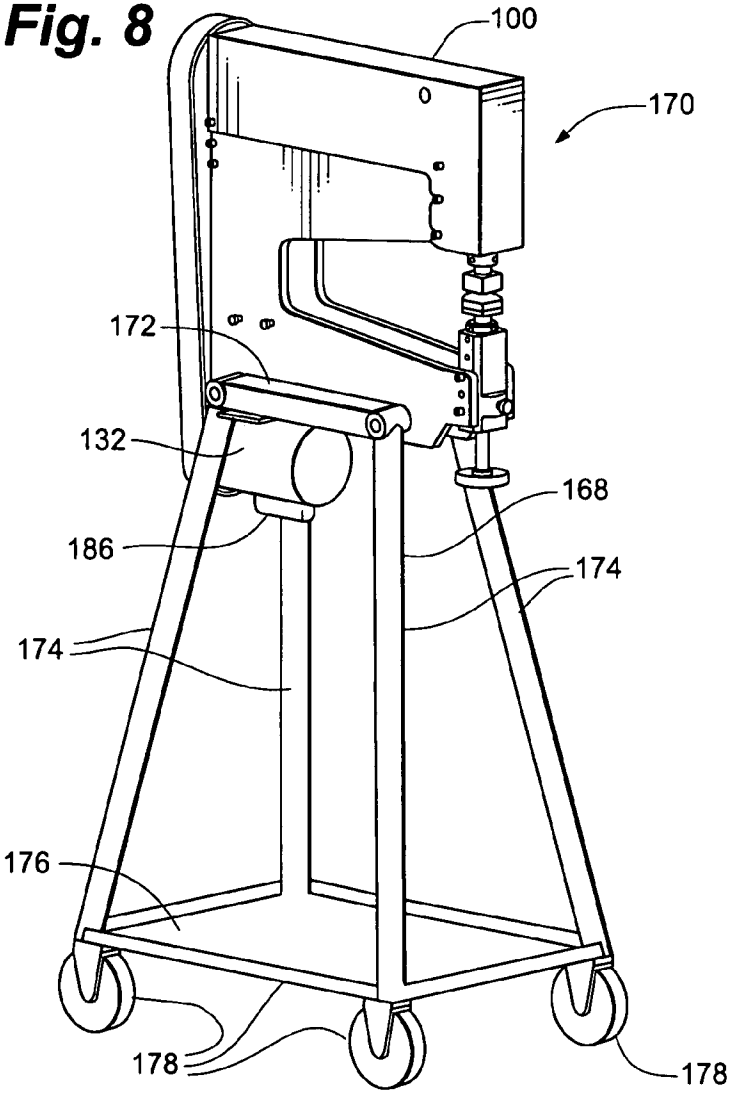
FIG. 8 is a perspective view of the power hammer assembly of FIG. 1 mounted on a portable stand for shaping a piece of metal.
Figure 10A:
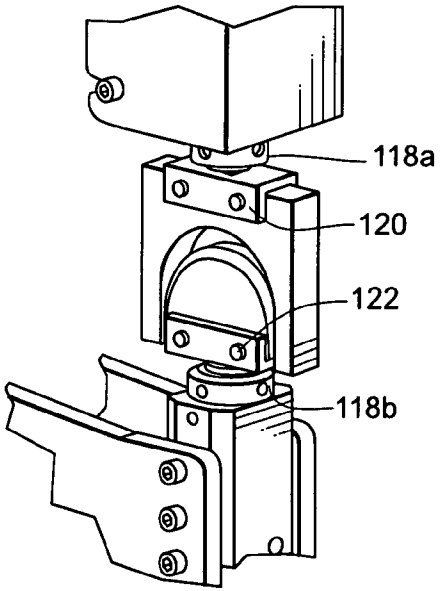
FIG. 10*a* is an enlarged perspective view of the die holder portion of the power hammer assembly taken at Detail A of FIG. 10.
Figure 10:
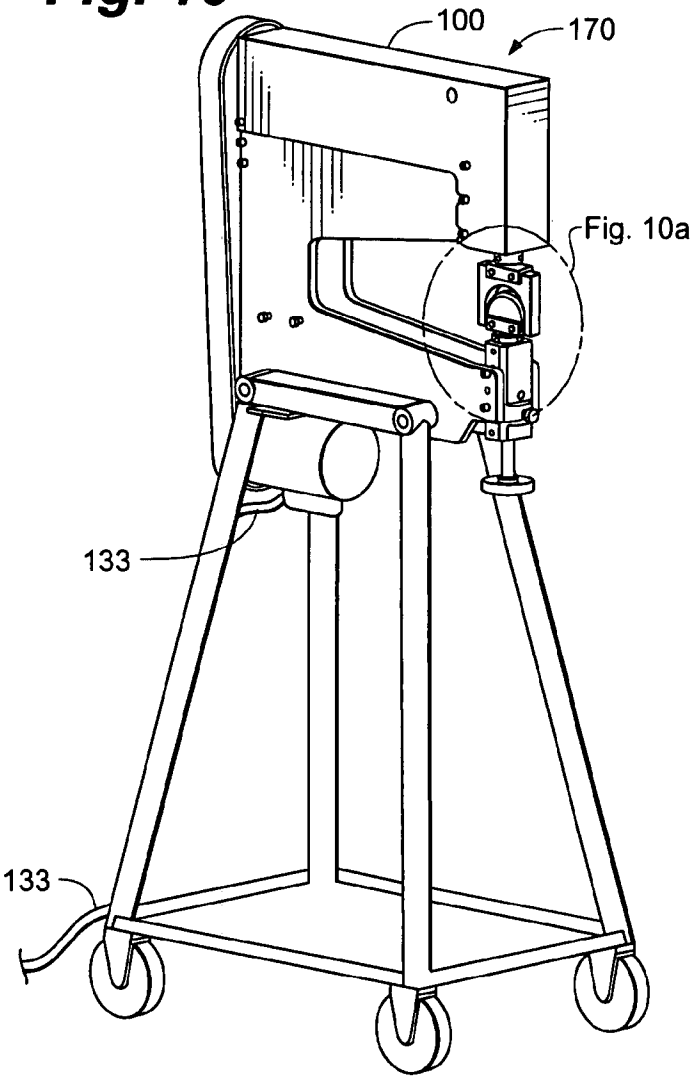
FIG. 10 is a perspective view of a die holder portion of the power hammer assembly of FIG. 1.

As shown in detail in FIGS. 2 and 3, body assembly 102 comprises a pair of support base assemblies 112*a*, 112*b*, a pair of side plates 114*a*, 114*b*, a pair of base spacers 115 and a shroud cover 116. Forming die portion 104 comprises a pair of die holders 118*a*, 118*b*, a female shrinking die 120 and a male shrinking die 122. Female shrinking die 120 and male shrinking die 122 can comprise machined, hand polished hardened steels such as, for example, 4140 hardened steels. Female shrinking die 120 and male shrinking die 122 can comprise shanks such as, for example, 0.75" by 0.75" square shanks, for attaching the female shrinking die 120 and male shrinking die 122 to the die holders 118*a*, 118*b*. Die adjustment portion 106 comprises an adjustment wheel 124, an adjustment rod 126, an adjustment sleeve 128, a sleeve cross bolt 129 and an adjustment collet 130. Motor portion 104 can comprise an electric motor 132 having a power cord assembly 133 as shown in FIG. 8. In one representative, presently preferred embodiment, electric motor 132 can comprise a one horsepower, 115 VAC, single-phase motor allowing for convenient electrical hookup to typical residential and commercial power sources. Belt transmission portion 110 can comprise a belt cover 134, a belt cover lid 136, a top pulley 138, a bottom pulley 140, a belt 142, a rear spacer plate 144, a pair of flange bearings 146, an offset shaft 148, a front mount plate 150, a connecting rod 152, a bearing 153, a slider 154, a bushing 155, a top collet 156, a bushing 158, a slide guide 160, an alignment key stock 162 and a support key stock 164. Bottom pulley 140 is adapted for slidable placement and fixation over the motor shaft 166.

Female shrinking die 120 and male shrinking die 122 are disclosed and described for illustration purposes only as one of skill in the art will recognize that a variety of alternative die set designs can be employed with the present invention. Representative, alternative die set designs can comprise stretching die sets, beading die sets, flanging die sets, doming die sets, plannishing die sets and flaring die sets. During use, die sets are routinely changed out based on the desired shape to be formed. By selectively configuring adjustment collet 130 and top collet 156, dies sets having alternative shank sizes such as, for example, 0.375" by 0.375", 0.5" by 0.5" and 0.625" by 0.625" (as well as various metric sizes), can be utilized with power hammer assembly 100. Furthermore, spacers such as, for example, an L-shaped spacer can be used to adjust the configuration of adjustment collet 130 and top collet 156.

Figure 9:
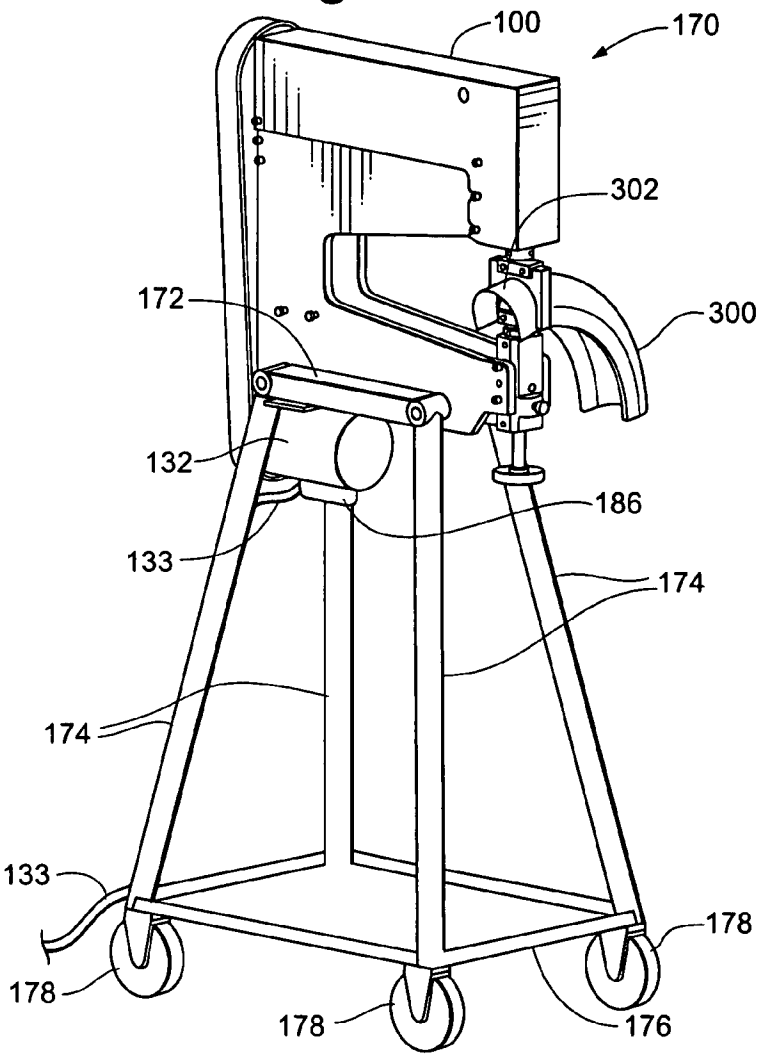
FIG. 9 is a perspective view of the power hammer assembly of FIG. 3 shaping a piece of metal.

As illustrated in FIGS. 8 and 9, power hammer assembly 100 can be assembled and placed on a portable stand assembly 168 to form a portable power hammer assembly 170. Portable stand assembly 168 can comprise a mounting element 172, stand legs 174, support member 176 and a plurality of caster assemblies 178. Using support base assembly 112, power hammer assembly 100 can be fixedly mounted to mounting element 172 such that a user can rollingly position the portable power hammer assembly 170 in a variety of locations for use and/or storage. In addition, when a 115 VAC, single-phase electric motor 132 is used, portable power hammer assembly 170 can be positioned anywhere 115 VAC power is available.

Figure 4:
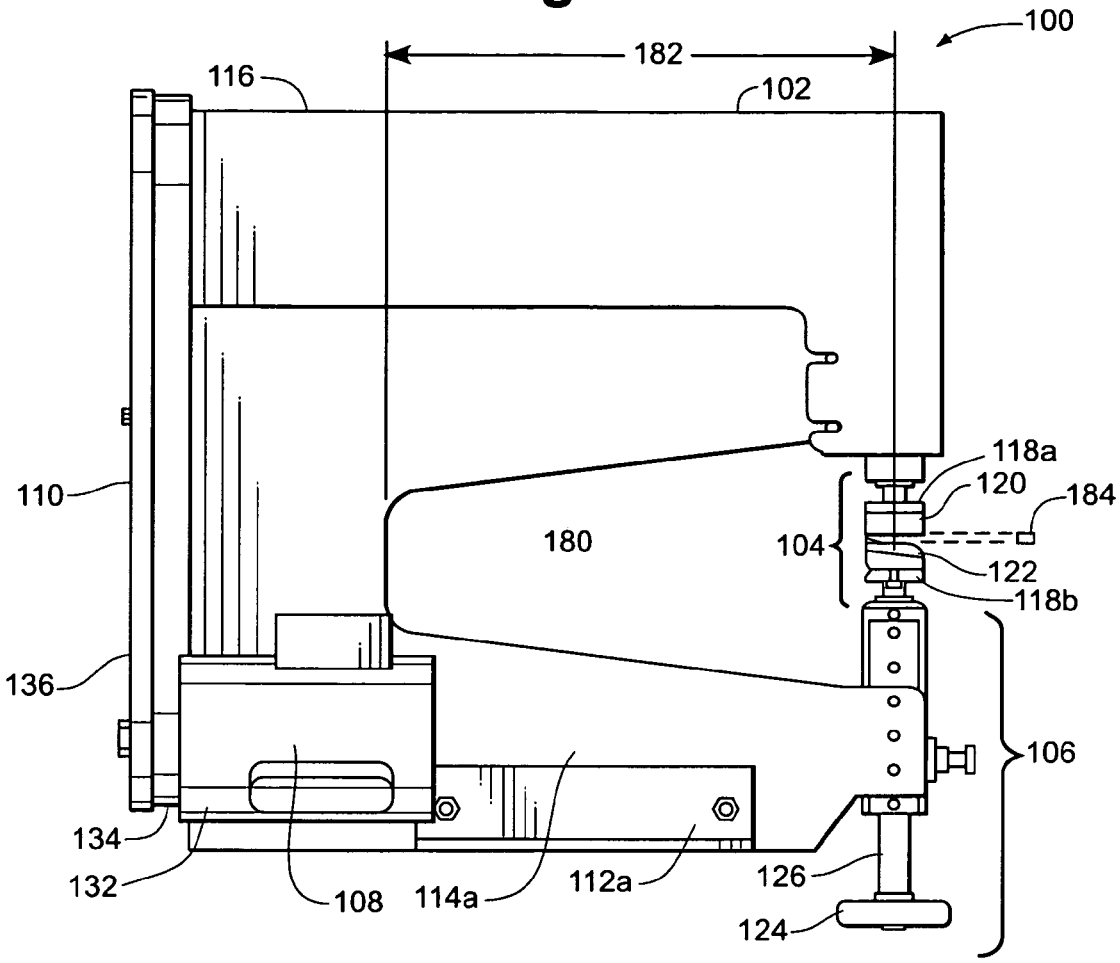
FIG. 4 a partially hidden, side view of the power hammer assembly of FIG. 1.
Figure 5:
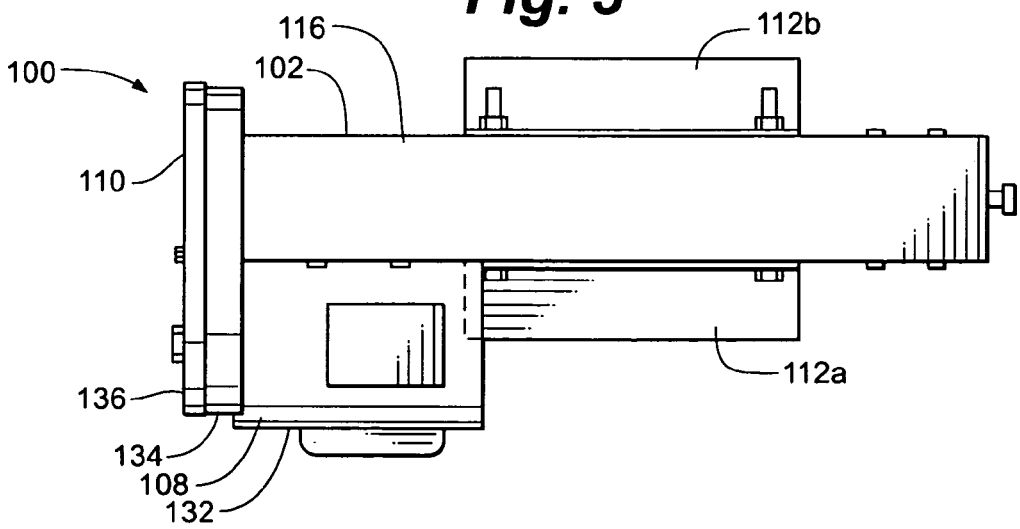
FIG. 5 is partially hidden, top view of the power hammer assembly of FIG. 1.
Figure 6:
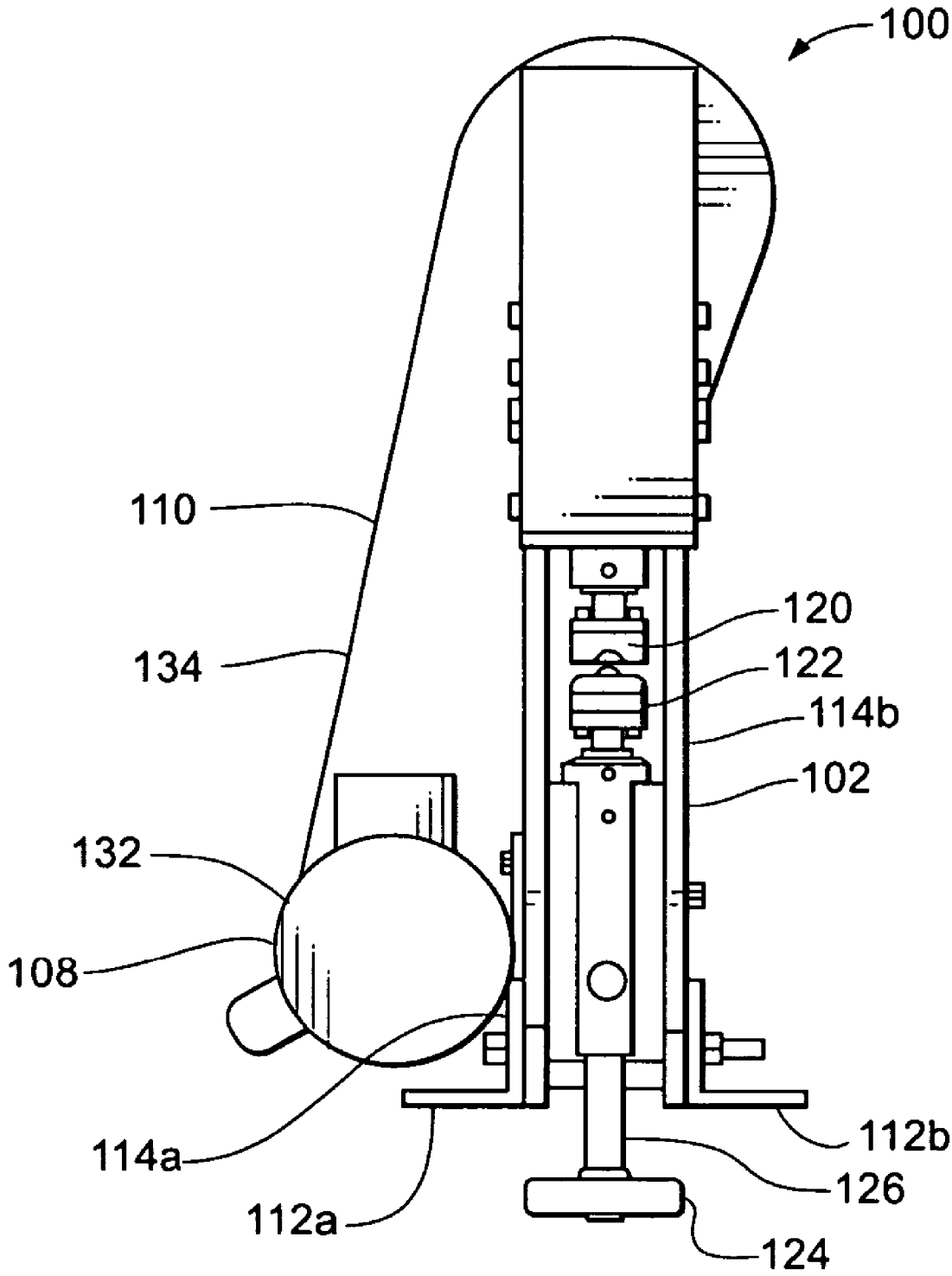
FIG. 6 is a partially hidden, front view of the power hammer assembly of FIG. 1.
Figure 7:
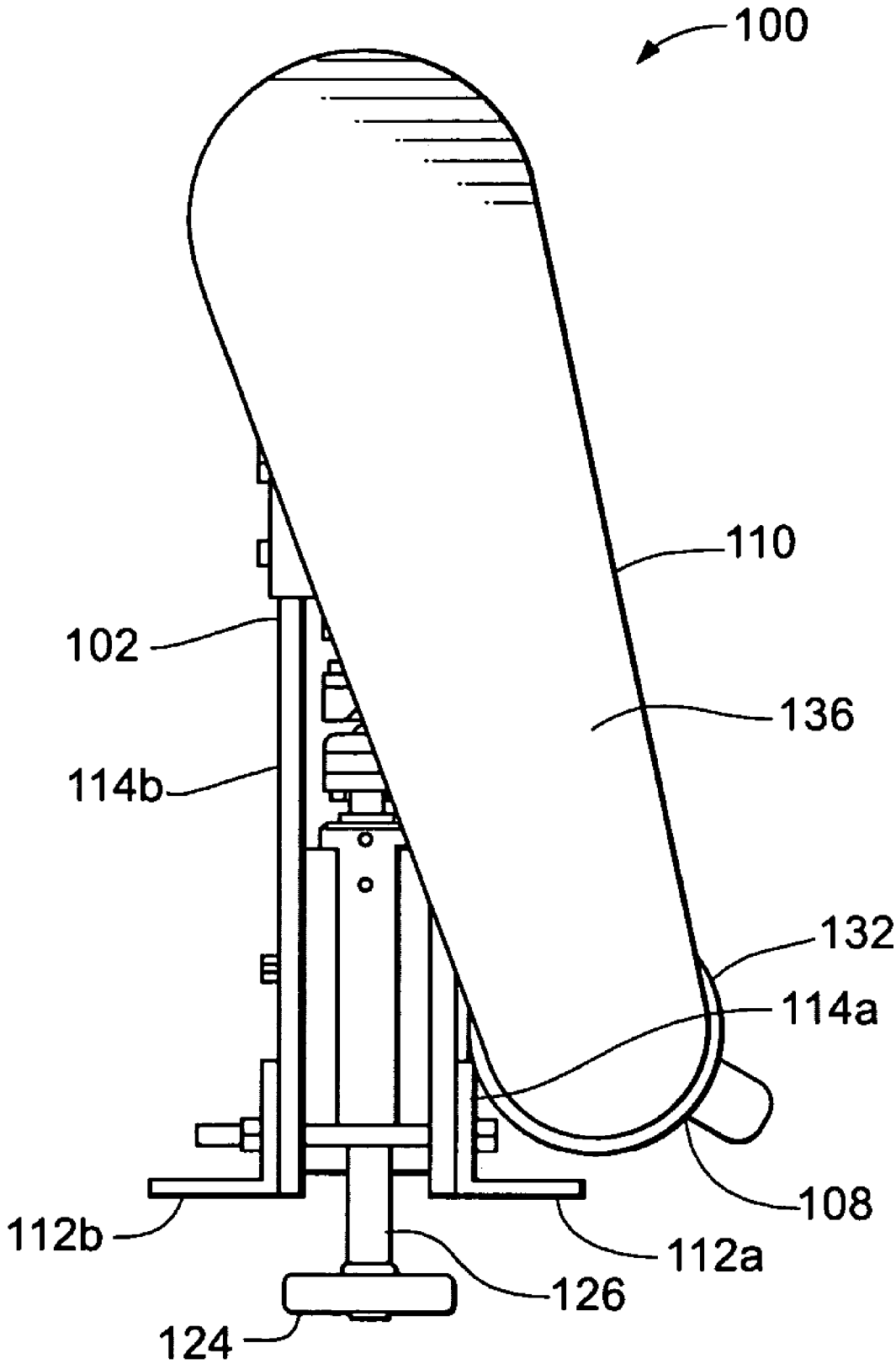
FIG. 7 is a partially hidden, rear view of the power hammer assembly of FIG. 1.

Referring to FIG. 4, power hammer assembly 100 comprises a fabrication area 180 defined by a throat depth 182 and a die opening 184. In one presently preferred embodiment, throat depth 182 comprises about an eighteen-inch depth providing power hammer assembly 100 the capacity to shape the middle of a thirty-six inch metal panel. Die opening 184 in one presently preferred embodiment is adjustable configurable through the use of die adjustment portion 106 from a maximum opening of about 6 inches to a minimum of about 0.5 inches. Die adjustment portion 106 provides power hammer assembly 100 with an infinitely adjustable lower die holder 118*b*. Adjustment rod 126 has a continuous thread such that lower die holder 118*b* and consequently, male shrinking die 122 can be adjustably lifted upwards toward the female shrinking die 120, through hand rotation of the adjustment wheel 124, to set the proper die opening 184. By providing an infinitely adjustable die adjustment portion 106, die holders 118*a*, 118*b* do not require machining to exact lengths such that die holders contemplated for and used with other machines can be interchangeably used with power hammer assembly 100.

When fully assembled, power hammer assembly 100 is capable of shaping metal such as, for example, shrinking metal through the multiple stamping operations as depicted in FIGS. 8 and 9. For example, using a one horsepower electric motor 132, female shrinking die 120 and male shrinking die 122 can be hit at a hit rate of about 900 hits per minute. Based on the desired three-dimensional shape to be formed, a user selects an appropriate die set such as, for example, female shrinking die 120 and male shrinking die 122. Once female shrinking die 120 and male shrinking die 122 have been attached to their corresponding die holder 118*a*, 118*b*, a user positions the piece of metal to be formed within the die opening 184 between the female shrinking die 120 and male shrinking die 122.

The user initiates operation of the power hammer assembly 100 by plugging in power cord assembly 133 and actuating a power actuator such as, for example, a pushbutton or switch assembly 186 as shown in FIG. 8. When switch 186 is in an operational position, electric motor 132 causes motor shaft 166 to begin rotating wherein bottom pulley 140 begins turning the driving belt 142. As driving belt 142 is rotated, top pulley 138 spins, which correspondingly provides, axial rotational motion to offset shaft 148. As offset shaft 148 spins, connecting rod 152 translates the rotational motion to a vertical, reciprocating motion wherein an up and down stamping motion is translated to female shrinking die 120 through slider 154. Depending upon the gauge of a metal sheet 300 being formed, the user turns adjustment wheel 124 to lift the male shrinking die 122 so as to define the appropriate die opening 184. As the metal sheet 300 is conformed to the selected die set such as, for example, female shrinking die 120 and male shrinking die 122, the metal sheet 300 assumes the desired three-dimensional shape such as, for example, custom motorcycle components such as a gas tank or fender 302 as illustrated in FIG. 9. In the event that the female shrinking die 120 and male shrinking die 122 interfere during operation or set-up, the belt transmission portion 110 causes belt 142 to slip so as to avoid damage to the power hammer assembly 100.

Upon completion of a desired forming operation, portable power hammer assembly 170 can have power cord assembly 133 unplugged such that caster assemblies 178 can be used to rollably position the portable stand assembly 168 in a desired storage position allowing the user to avoid permanently occupying work space.

Figure 11:
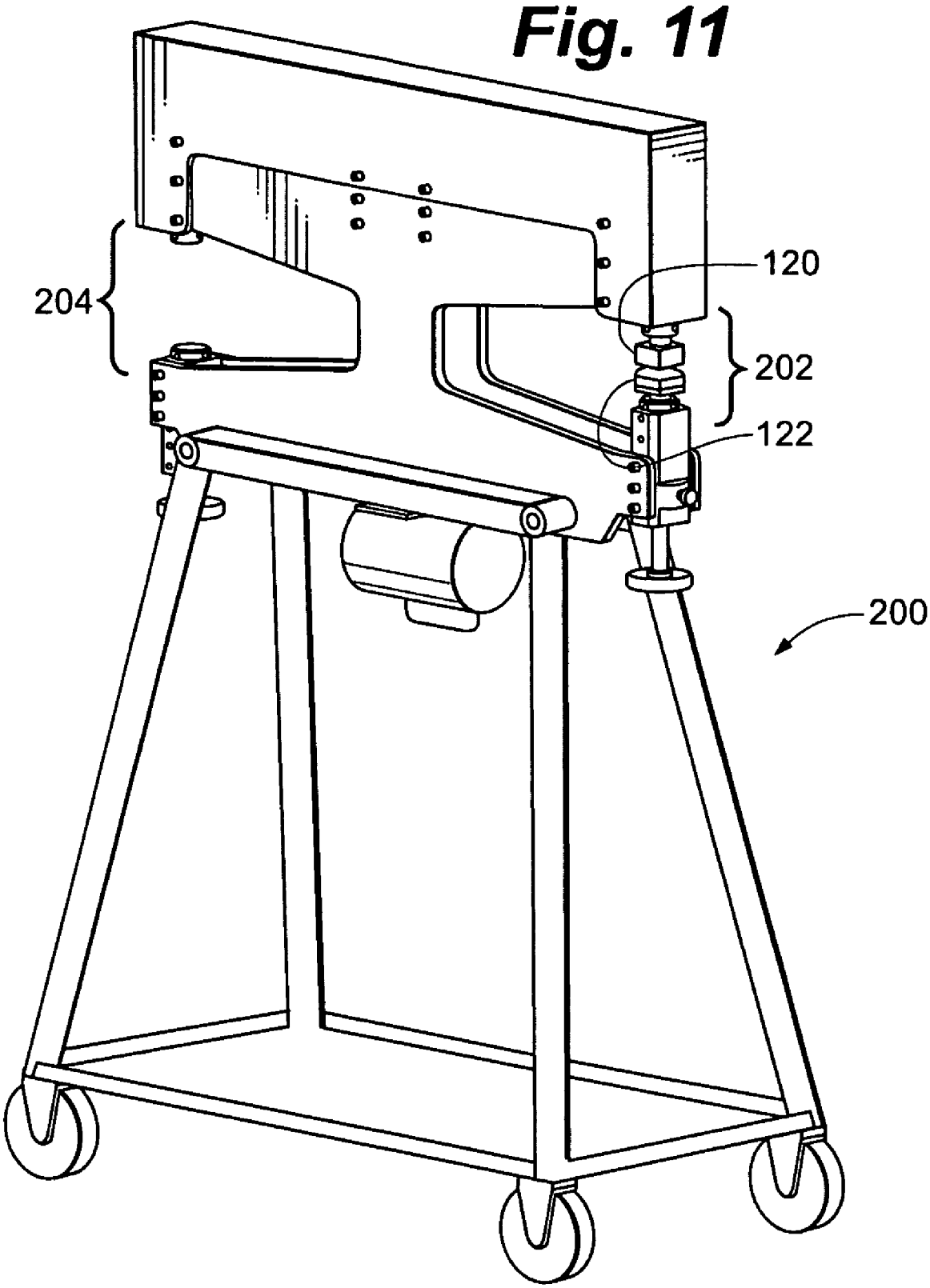
FIG. 11 is a perspective view of an embodiment of a dual work zone power hammer assembly.

An alternative, representative embodiment of a dual work zone power hammer assembly 200 is illustrated in FIG. 11. Dual work zone power hammer assembly 200 can substantially resemble power hammer assembly 100 with the exception that dual work zone power hammer assembly 200 comprises both a first forming die portion 202 and a second forming die portion 204. First forming die portion 202 and second forming die portion 204 can be actuated and operated so as to allow for simultaneous shaping operations or alternatively, first forming die portion 202 and second forming die portion 204 can comprise selected die sets such as, for example, female shrinking dies 120 and male shrinking dies 122, so as to allow a first forming operation in the first forming die portion 202 and a second forming operation in the second forming die portion 204. Both dual work zone power hammer assembly 200 and power hammer assembly 100 can comprise a direct current variable speed drive 206 so as to provide the capability for controlling the strike rate of the dies sets such as, for example, reducing the rate of die strikes.

The present disclosure describes aspects of one presently preferred embodiment of a power hammer assembly for economically providing three-dimensional metal shaping capabilities. It will be understood by one of skill in the art that additional, alternative embodiments are contemplated and would not depart from the spirit and scope of the present disclosure.

What is claimed is:

1. A power hammer assembly comprising:

a body assembly;

a motor assembly operably connected to the body assembly;

an upper die assembly having a transmission portion and an upper forming die, the transmission portion attached to the motor assembly such that the upper forming die is driven in a vertical, reciprocating motion;

a lower die assembly having a die adjustment assembly and a lower forming die, the die adjustment assembly allowing the lower forming die to be selectively positioned relative to the upper forming die to define a die opening between the lower forming die and the upper forming die; and a second upper forming die and a second lower forming die, the second upper forming die having a second upper shank length different from an upper shank length of the upper forming die and the second lower forming die having a second lower shank length different from a lower shank length of the lower forming die, wherein the means for vertically positioning the lower forming die selectively positions the lower forming die so as to vary the die opening to accommodate the second upper forming die and the second lower forming die.

2. The power hammer assembly of claim 1, wherein the upper die assembly includes an upper adjustable collet and the lower die assembly includes a lower adjustable collet such that the upper die assembly and the lower die assembly are adapted to accept a plurality of die shank configurations for the upper forming die and the lower forming die.

3. The power hammer assembly of claim 1, wherein the die adjustment assembly comprises an adjustment wheel and a threaded adjustment rod wherein the lower forming die is operably coupled to the threaded adjustment rod such that turning the adjustment wheel sets the position of the lower forming die with respect to the upper die assembly.

4. The power hammer assembly of claim 1, wherein the transmission portion comprises a belt-drive transmission interconnecting the motor assembly with the upper forming die and wherein interference between the upper forming die and the lower forming die during operation results in slippage of the belt-drive transmission.

5. The power hammer assembly of claim 1, wherein the body assembly comprises a portable stand assembly having a plurality of support legs and casters.

6. The power hammer assembly of claim 1, wherein the die opening can be varied from a minimum opening of about 0.5 inches to a maximum opening of about 6.0 inches.

7. The power hammer assembly of claim 1, further comprising a second upper die assembly and a second lower die assembly such that the body assembly has a dual work zone configuration wherein both the second upper die assembly and the upper die assembly are driven by the motor in a vertical, reciprocating motion.

8. A power hammer assembly comprising:

a body assembly;

an upper die assembly having an upper forming die and a means for driving the upper forming die wherein the means for driving the upper forming die directs the upper forming die in a vertical, reciprocating motion;

a lower die assembly having a lower forming die and a means for vertically positioning the lower forming die, the means for vertically positioning the lower forming die allowing the lower forming die to be raised and lowered with respect to the upper forming die so as to selectively define a die opening between the lower forming die and the upper forming die; and a second upper forming die and a second lower forming die, the second upper forming die having a second upper shank length different from an upper shank length of the upper forming die and the second lower forming die having a second lower shank length different from a lower shank length of the lower forming die, wherein the means for vertically positioning the lower forming die selectively positions the lower forming die so as to vary the die opening to accommodate the second upper forming die and the second lower forming die.

9. The power hammer assembly of claim 8, wherein the means for vertically positioning the lower forming die comprises a threaded adjustment rod and an adjustment wheel wherein rotation of the adjustment wheel directs the lower forming die assembly vertically along the threaded adjustment rod.

10. The power hammer assembly of claim 8, wherein the means for driving the upper forming die comprises a motor and a transmission portion, the transmission portion operably interconnecting the motor and the upper forming die.

11. The power hammer assembly of claim 10, wherein the transmission portion comprises a belt-drive transmission wherein interference during set-up or operation between the upper forming die and the lower forming die results in slippage of the transmission portion.

12. A method for forming metal with a power hammer comprising:

selecting a die set having a top forming die and a bottom forming die for shaping a metal sheet;

attaching the top forming die to a top die holder and the bottom forming die to bottom die holder;

positioning the bottom forming die to establish a selected die opening defined between the top forming die and the bottom forming die wherein the selected die opening corresponds to the metal sheet;

actuating a motor to generate a reciprocating, vertical motion for the top forming die;

replacing the die set with a second die set having a second top forming die and a second bottom forming die, the second die set having a second shank length different from a shank length of the die set; and positioning the second bottom forming die to establish a second selected die opening defined between the second top forming die and the second bottom forming die.

13. The method of claim 12; wherein positioning the bottom forming die comprises turning an adjustment wheel wherein the bottom die holder is vertically positioned along a threaded adjustment rod.

* * * * *